US006694643B1

(12) United States Patent
Hsu

(10) Patent No.: US 6,694,643 B1
(45) Date of Patent: Feb. 24, 2004

(54) SHOELACE ADJUSTMENT MECHANISM

(76) Inventor: Cheng-Hui Hsu, No.126, Pao Chung Road, Hsin Tien City, Taipei Hsien (TW)

( * ) Notice: Subject to any disclaimer, the term of this patent is extended or adjusted under 35 U.S.C. 154(b) by 0 days.

(21) Appl. No.: 10/407,442

(22) Filed: Apr. 7, 2003

(51) Int. Cl.[7] ..... A43C 11/00
(52) U.S. Cl. ..... 36/50.1; 24/712.1; 24/712.3
(58) Field of Search ..... 36/50.1, 50.5; 24/712.1, 713.4, 712.3

(56) References Cited

U.S. PATENT DOCUMENTS 5,157,813 A * 10/1992 Carroll ..... 36/50.1
5,177,882 A * 1/1993 Berger ..... 36/50.1
5,327,662 A * 7/1994 Hallenbeck ..... 36/50.1
5,502,902 A * 4/1996 Sussmann ..... 36/50.1
5,848,457 A * 12/1998 Silagy ..... 24/712.1

FOREIGN PATENT DOCUMENTS

EP 290847 * 11/1988

* cited by examiner

*Primary Examiner*—Ted Kavanaugh
(74) *Attorney, Agent, or Firm*—Rosenberg, Klein & Lee

(57) ABSTRACT

A shoelace adjustment mechanism that provides for fastening shoelaces on shoes in which a shoelace is contiguously routed through a tightening and securing structure consisting of a plurality of shoelace winding sheaves along with the shoelace adjustment mechanism disposed on the left vamp and the right vamp such that the arrangement is capable of the rapid shoelace tensioning and loosening, the shoelace adjustment mechanism of the invention herein thereby affording greater practical value.

1 Claim, 7 Drawing Sheets

SHOELACE ADJUSTMENT MECHANISM

BACKGROUND OF THE INVENTION

1) Field of the Invention

The invention herein relates to footwear componentry, specifically a shoelace adjustment mechanism, wherein a shoelace is contiguously routed through a tightening and securing structure consisting of a plurality of shoelace winding sheaves along with the shoelace adjustment mechanism disposed on the left vamp and the right vamp such that the arrangement is capable of rapid shoelace tensioning and loosening, the shoelace adjustment mechanism of the invention herein thereby affording greater practical value.

2) Description of the Prior Art

A conventional shoe typically has a plurality of eyelets disposed in the left and the right vamps through which a shoelace is inserted is an alternating crisscross fashion and then tightened and loosened to provide for wearing the shoe. The interlacing and tying approach of such conventional shoelaces is especially challenging for grade-school children, whose shoelaces often loosen because of poor knotting and insufficient tension, with the situation even more difficult for younger children. In view of such shortcomings and the need to make the tie-on type shoelace more practical, the applicant of the invention herein conducted research and development to further improve its practical value through the invention herein based on numerous years of professional experience gained while engaged in manufacturing. Following extensive testing and refinement, the applicant successfully complete the shoelace adjustment mechanism of the present invention.

SUMMARY OF THE INVENTION

The primary objective of the invention herein is to provide a shoelace adjustment mechanism in which a shoelace is contiguously routed through a tightening and securing structure consisting of a plurality of shoelace winding sheaves along with the shoelace adjustment mechanism disposed on the left vamp and the right vamp such that the arrangement is capable of rapid shoelace tensioning and loosening, thereby affording the shoelace adjustment mechanism of the invention herein greater practical value.

To enable the examination committee a further understanding of the structural features and innovative content as well as the advantages and other particulars of the present invention, the brief description of the drawings below are followed by the detailed description of the invention herein.

DETAILED DESCRIPTION OF THE INVENTION

Figure 1:
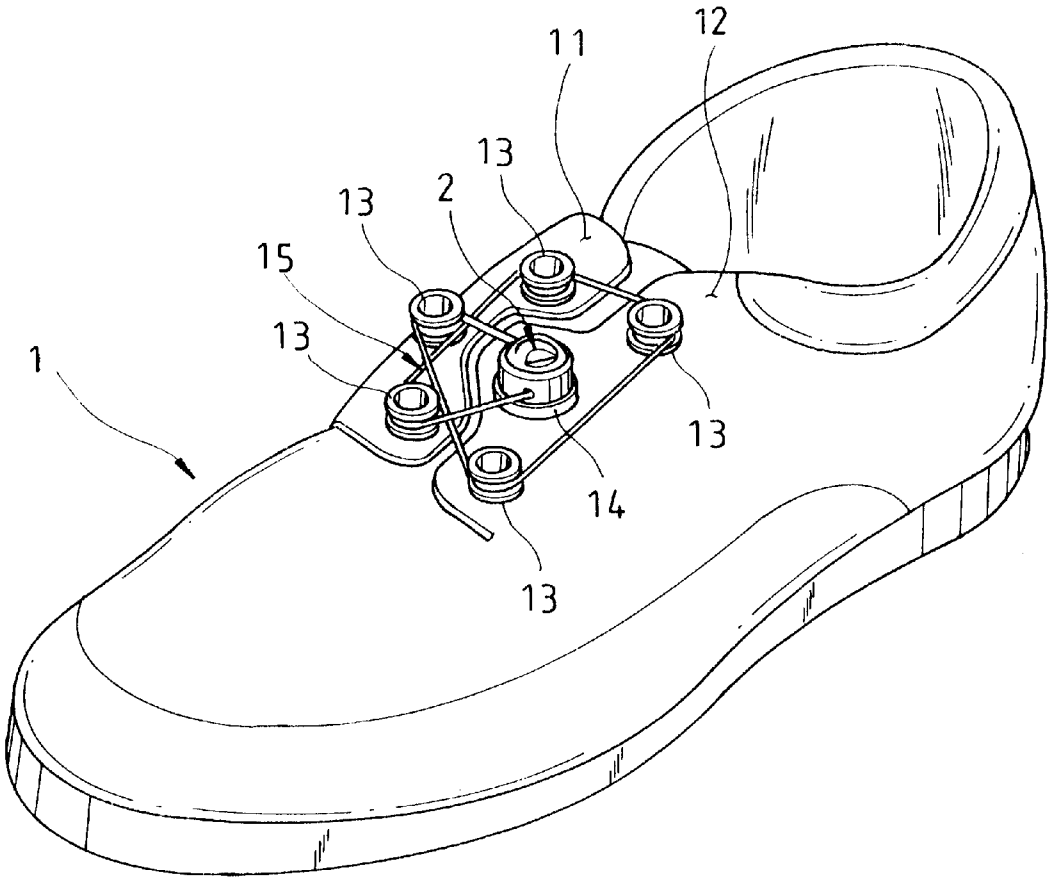
FIG. 1 is an isometric drawing of the invention herein.
Figure 2:
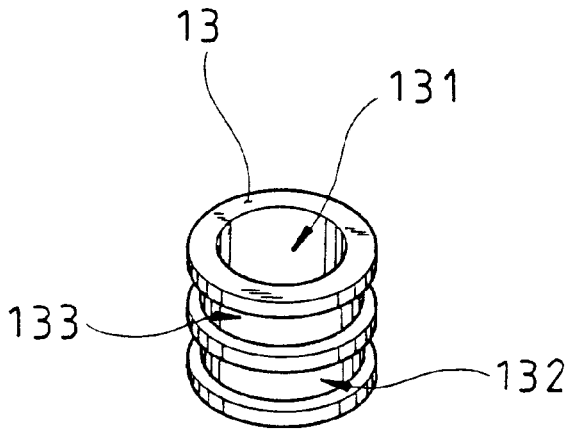
FIG. 2 is an isometric drawing of the shoelace winding sheave 13 of the invention herein.
Figure 3:
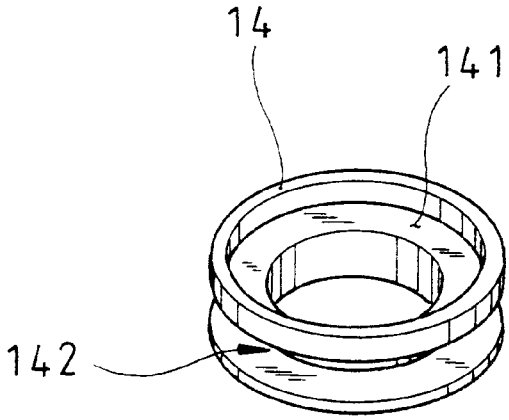
FIG. 3 is an isometric drawing of the bearing block 14 of the invention herein.
Figure 4:
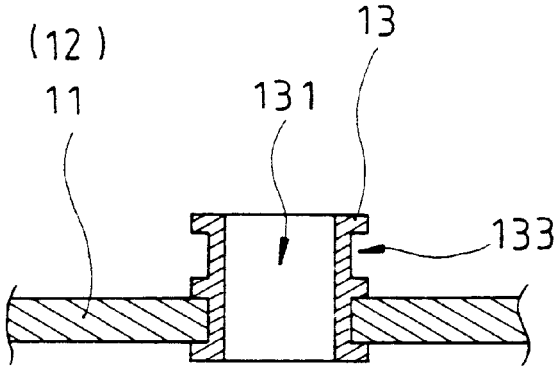
FIG. 4 is a cross-sectional drawing of the shoelace winding sheave 13 and the left and right vamps 11 and 12.
Figure 5:
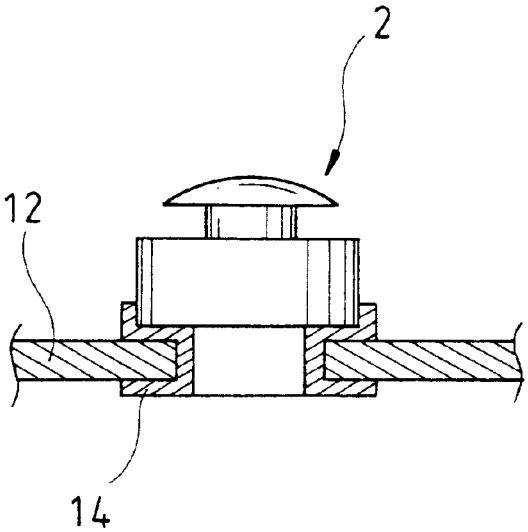
FIG. 5 is a cross-sectional drawing of the shoelace adjustment mechanism 2 of the invention herein and the left vamp 12.

Referring to FIG. 1, FIG. 2, FIG. 3, FIG. 4, and FIG. 5, the invention herein includes a plurality of shoelace winding sheaves 13 disposed on the left vamp 11 and the right vamp 12 of a shoe 1, with a shoelace 15 of an appropriate length routed tensively between a shoelace adjustment mechanism 2 capable of automatic shoelace tightening or loosening and the plurality of shoelace winding sheaves 13. Each said shoelace winding sheave 13 is a hollow tubular construct having an axial hole 131 through the center and an annular binding groove 132 formed around the exterior that are mounted in the left vamp 11 or the right vamp 12 and, furthermore, an annular bearing groove 133 formed around the said shoelace winding sheave 13. There is a bearing block 14, a hollow tubular component having a load flange 141 along the upper level, interior side, and an annular binding groove 142 around the exterior that is mounted in the right vamp 12, with the said shoelace adjustment mechanism 2 seated on the load flange 141 at the upper level of the bearing block 14.

Figure 6:
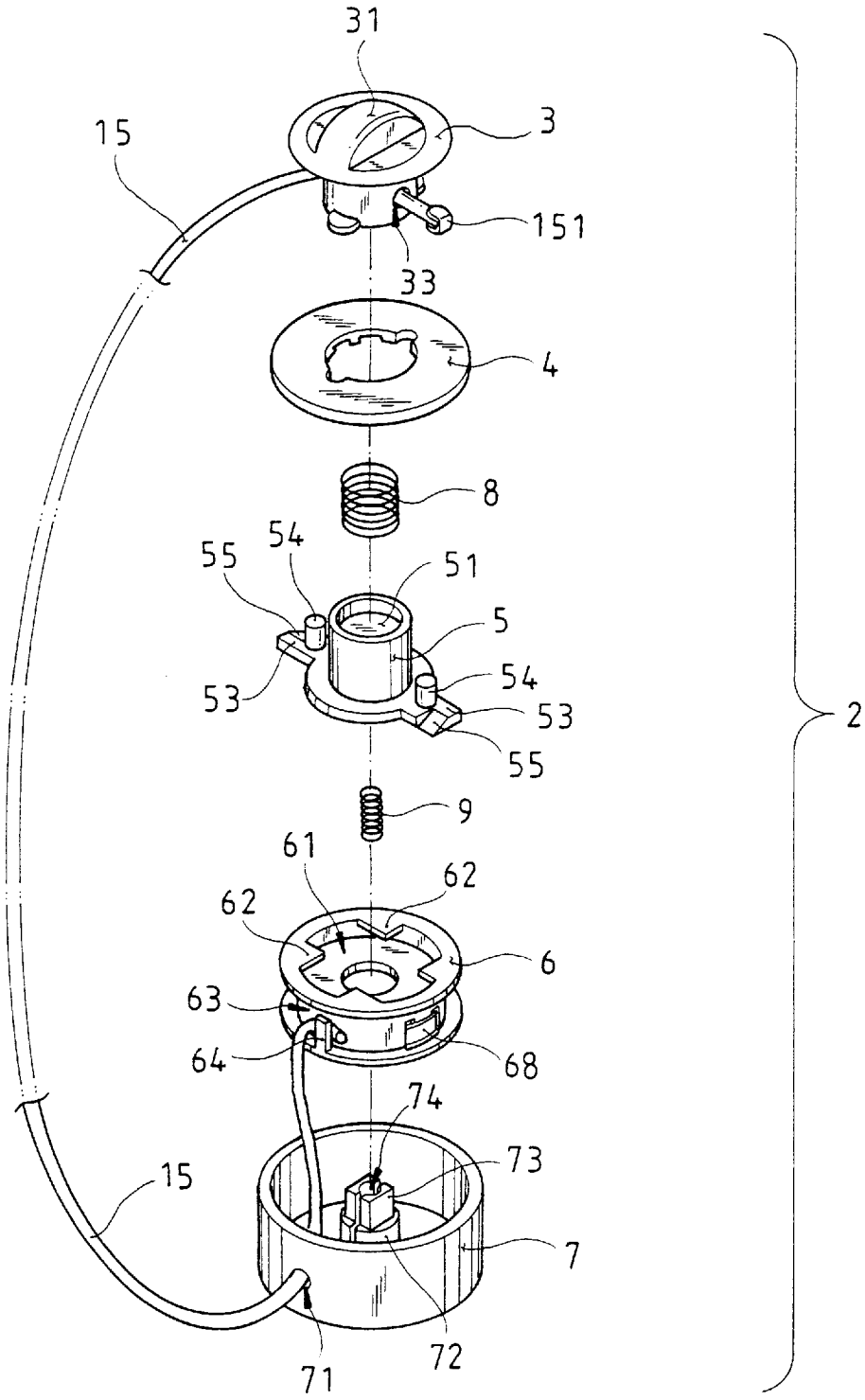
FIG. 6 is an exploded drawing of the shoelace adjustment mechanism 2 of the invention herein.
Figure 7:
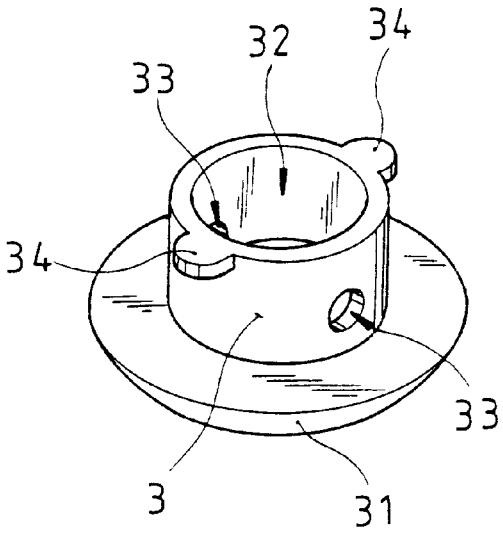
FIG. 7 is an isometric drawing of the push button 3 of the invention herein, as viewed from the rear.

Referring to FIG. 6, the said shoelace adjustment mechanism 2 is comprised of a push button 3, a cover plate 4, a coupling component 5, a reel 6, a lower base 7, a helical and a coil spring 8 and 9, and the shoelace 15, wherein:

The said push button 3, referring to FIG. 7, has an arcuate prominence 31 across the top edge, a bore 32 formed within its tubular body and, furthermore, two holes 33 disposed through the tubular body, and a semicircular lock tab 34 situated on two sides at the bottom edge of the said push button 3.

Figure 8:
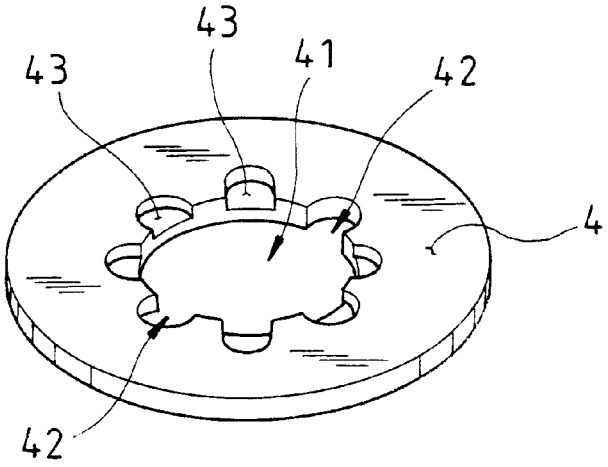
FIG. 8 is an isometric drawing of the cover plate 4 of the invention herein, as viewed from the rear.

The cover plate 4, referring to FIG. 8, has a circular opening 41 through its center; a semicircular notch 42 is reticulated at two extremities of the cover plate 4 inner surface and, furthermore, a plurality of semicircular locating indentations 43 are arrayed at equal intervals along the inner surface of the cover plate 4.

Figure 9:
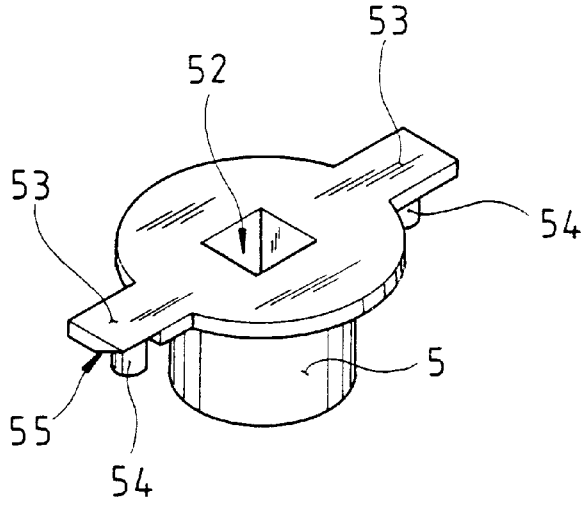
FIG. 9 is an isometric drawing of the coupling component 5 of the invention herein, as viewed from the rear.

The coupling component 5, referring to FIG. 9, has a round recess 51 disposed in one end and a square recess 52 in its other end; a lock tab 53 projects from each of the two sides of the said coupling component 5, a pin 54 is situated on one side of each said lock tab 53 and, furthermore, a beveled surface 55 is formed at the extreme lateral edges of the said lock tabs 53.

Figure 10:
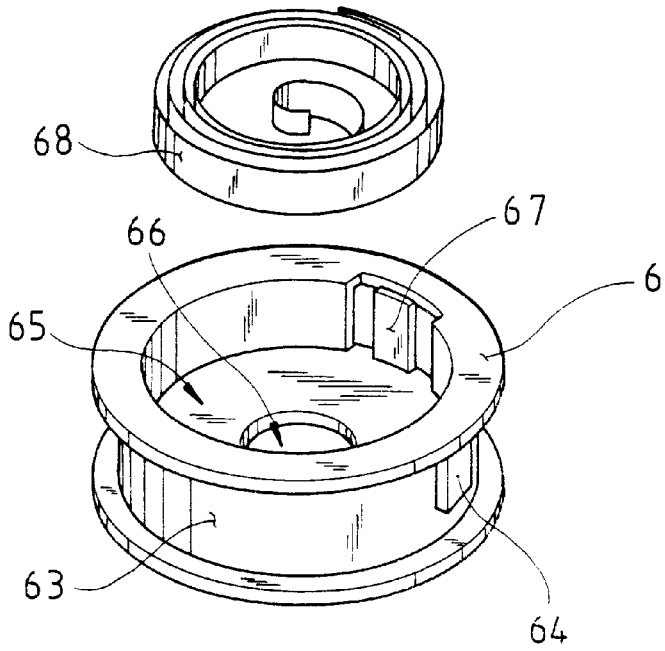
FIG. 10 is an isometric drawing of the spool 6 of the invention herein, as viewed from the rear.

The reel 6, referring to FIG. 10, has a round recess 61 formed inside one end and, furthermore, with a plurality of check blocks 62 protruding inward from its top extent; an annular spooling groove 63 is disposed around the exterior of the said reel 6 and a clasp tab 64 protrudes from one side of the said spooling groove 63; a circular recess 65 is formed inside one end of the said reel 6 and a hole 60 is fabricated through the center; a retaining tab 67 is situated on the inner lateral extent of the circular recess 65 and a concentric spring 68 of a multi-wound arrangement is contained in the circular recess 65 with its outermost extremity secured onto the restraining tab 67.

The lower base 7 is discoidal in shape and has a perforation 71 through one side and a spindle shaft 72 projecting from the center of its bottom extent, the said spindle shaft 72 having a rectangular mounting column 73 at the tip, a hole 74 in the center, and a slot imposed along the center.

To enable the said shoelace adjustment mechanism 2 of the invention herein, one extremity of the shoelace 15 is inserted through the perforation 71 of the lower base 7 and attached to the clasp tab 64 at one side of the reel 6 spooling groove 63, while the opposite extremity of the shoelace 15 is inserted through the holes 33 of the push button 3 and restrained at one side of the push button 3 by means of a clip 151; the said reel 6 is sleeved onto the lower base 7 spindle shaft 72, wherein the center extremity of the concentric spring 68 is inserted into the slot of the spindle shaft 72, the spindle shaft 72 is extended through the round recess 61 of the reel 6, the coil spring 9 is placed into the hole 74 in the center of the rectangular mounting column 73 at the tip of the spindle shaft 72 and, furthermore, such that the said coil spring 9 protrudes slightly from the mounting column 73; the square recess 52 in the bottom extent of the coupling component 5 is snug fitted onto the rectangular mounting column 73 at the tip of the spindle shaft 72 and, furthermore, the said lock tabs 53 engage the check blocks 62 at the top extent of the reel 6; the helical spring 8 is placed within the round recess 51 in the top extent of the coupling component 5, the bore 32 formed within the push button 3 sleeved onto the top end of the coupling component 5, and the cover plate 4 and the lower base 7 are conjoined to complete the entire shoelace adjustment mechanism 2.

Figure 11:
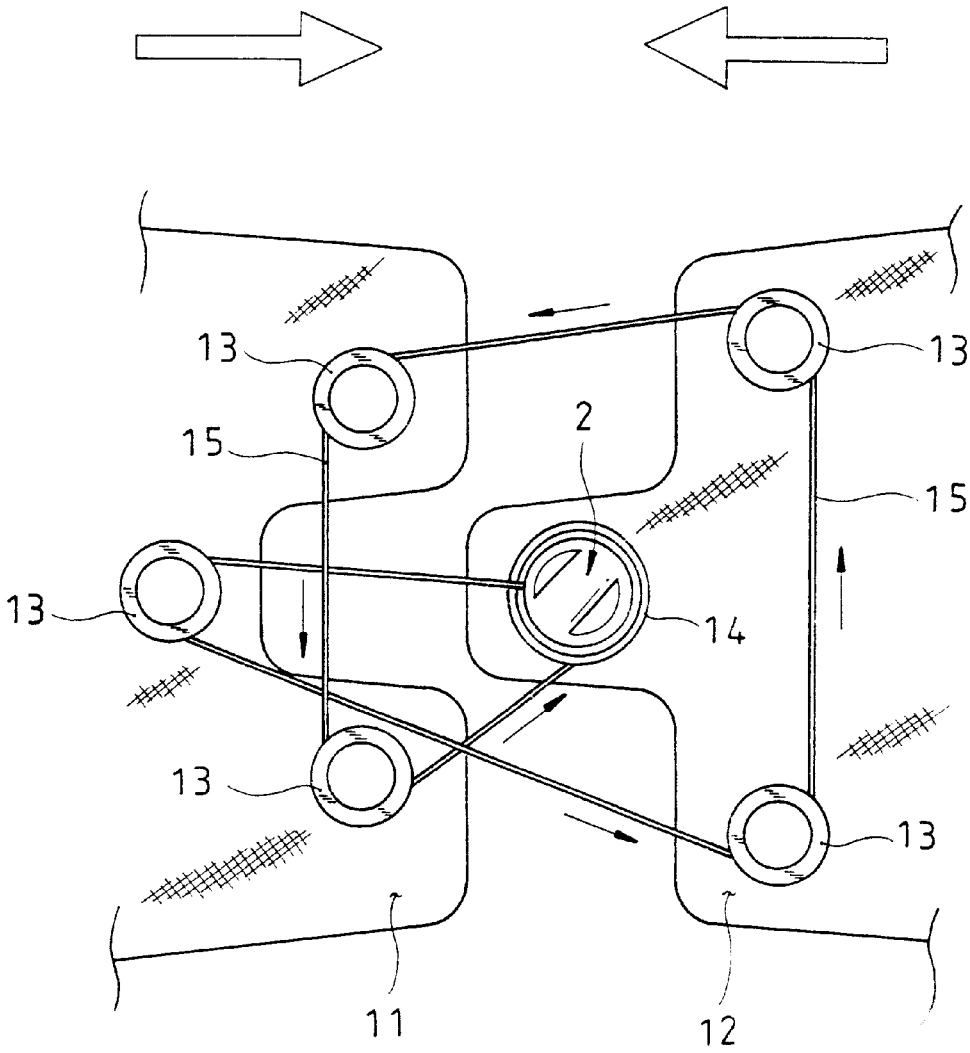
FIG. 11 is an orthographic drawing of an embodiment of the invention herein.

Following the assembly of the said structural components, the said shoelace 15 is routed between the plurality of shoelace winding sheaves 13 on the left vamp 11 and the right vamp 12 and the shoelace adjustment mechanism 2; the said shoelace 15 is of an appropriate routing length according to differences in shoe size, one extremity of the shoelace 15 is attached to the clasp tab 64 at one side of the reel 6 and the opposite extremity of the shoelace 15 is inserted through the holes 33 of the push button 3 and restrained at one side of the push button 3 with a clip 151; the concentric spring 68 contained in the circular recess 65 is capable of powerfully and automatically revolving the reel 6, since the lock tab 53 projecting from each of the two sides of the coupling component 5 engage the check blocks 62 protruding inward from its top extent of the reel 6, when the user depresses the push button 3 of the shoelace adjustment mechanism 2, the coupling component 5 is shoved down at the same time, causing the disengagement of the lock tabs 53 at the two sides of the coupling component 5 from the reel 6 check blocks 62 and releasing the torque of the concentric spring 68 such that the reel 6 automatically draw in the shoelace 15, with said shoelace 15 moved in the direction indicated by the arrowheads shown in FIG. 11 to simultaneously pull the left vamp 11 and the right vamp 12 closer together; to loosen the shoelace 15, the push button 3 is depressed once again, after which the vamps are spread apart by the slipping out the feet.

The push button 3 of the invention herein can also be partially depressed to disengage the lock tabs 34 situated on two sides at the bottom edge of the said push button 3 from the semicircular locating indentations 43 of the cover plate 4 and then rotated clockwise or counter-clockwise to tighten or loosen a small section of the shoelace 15 and thereby finely vary the degree of overall shoelace tension.

In summation of the foregoing section, since the invention herein improves upon the shortcomings of the conventional product, is an original arrangement among products in the same category, provides even greater practicality, and the disclosed structure is definitely capable of achieving its claimed objectives, the present invention is submitted for review and the granting of the commensurate patent rights.

What is claimed is:

1. A shoelace adjustment mechanism, wherein a plurality of shoelace winding sheaves are disposed on the left vamp and the right vamp of a shoe, with a shoelace of an appropriate length routed tensively between the said shoelace adjustment mechanism capable of automatic shoelace tightening or loosening and the said plurality of shoelace winding sheaves; each said shoelace winding sheave is a hollow tubular construct having an axial hole through the center and an annular binding groove formed around the exterior that are mounted in the said left vamp or the said right vamp and, furthermore, an annular bearing groove formed around the said shoelace winding sheave; there is a bearing block, a hollow tubular component having a load flange along the upper level, interior side, and an annular binding groove around the exterior that is mounted in the said right vamp, with the said shoelace adjustment mechanism seated on the said load flange at the upper level of the said bearing block, the features of which include:

the said shoelace adjustment mechanism is comprised of a push button, a cover plate, a coupling component, a reel, a lower base, a helical and coil spring, and the said shoelace;

the said push button has an arcuate prominence across the top edge, a bore formed within its tubular body and, furthermore, two holes disposed through the tubular body, and a semicircular lock tab situated on two sides at the bottom edge of the said push button;

the said cover plate has a circular opening through its center; a semicircular notch is reticulated at two extremities of the cover plate inner surface and, furthermore, a plurality of semicircular locating indentations are arrayed at equal intervals along the inner surface of the said cover plate;

the said coupling component has a round recess disposed in one end and a square recess in its other end; a lock tab projects from each of the two sides of the said coupling component, a pin is situated on one side of each said lock tab and, furthermore, a beveled surface is formed at the extreme lateral edges of the said lock tabs;

the said reel has a round recess formed inside one end and, furthermore, with a plurality of check blocks protruding inward from its top extent; an annular spooling groove is disposed around the exterior of the said reel and a clasp tab protrudes from one side of the said spooling groove; a circular recess is formed inside one end of the said reel and a hole is fabricated through the center; a retaining tab is situated on the inner lateral extent of the said circular recess and a concentric spring of a multi-wound arrangement is contained in the said circular recess with its outermost extremity secured onto the said restraining tab;

the said lower base is discoidal in shape and has a perforation through one side and a spindle shaft projecting from the center of its bottom extent, the said spindle shaft having a rectangular mounting column at the tip, a hole in the center, and a slot imposed along the center;

to enable the said shoelace adjustment mechanism of the invention herein, one extremity of the said shoelace is inserted through the said perforation of the said lower base and attached to the said clasp tab at one side of the said reel spooling groove, while the opposite extremity of the said shoelace is inserted through the said holes of the said push button and restrained at one side of the said push button by means of a clip; the said reel is sleeved onto the said lower base spindle shaft, wherein the center extremity of the said concentric spring is inserted into the said slot of the said spindle shaft, the said spindle, shaft is extended through the said round recess of the said reel, the said coil spring is placed into the said hole in the center of the said rectangular mounting column at the tip of the said spindle shaft and, furthermore, such that the said coil spring protrudes slightly from the said mounting column; the said square recess in the bottom extent of the said coupling component is snug fitted onto the said rectangular mounting column at the tip of the said spindle shaft and, furthermore, the said lock tabs engage the said check blocks at the top extent of the said reel; the said helical spring is placed within the said round recess in the top extent of the said coupling component, the said bore formed within the said push button sleeved onto the top end of the said coupling component, and the said cover plate and the said lower base are conjoined to complete the entire said shoelace adjustment mechanism.

* * * * *